United States Patent [19]

Barrett

[11] Patent Number: 4,838,214

[45] Date of Patent: Jun. 13, 1989

[54] INTERNAL COMBUSTION ENGINE ASSEMBLY

[76] Inventor: George M. Barrett, R.R. #5, Galt, Ontario, Canada, N1R 5S6

[21] Appl. No.: 64,111

[22] Filed: Jun. 18, 1987

[51] Int. Cl.[4] ..... F01L 7/00

[52] U.S. Cl. ..... 123/41.69; 123/42; 123/81 C; 123/318

[58] Field of Search ..... 123/317, 318, 76, 41.69, 123/42, 44 D, 43 R, 65 VA, 59 AC, 312, 80 BA, 80 C, 81 C, 190 C, 56 AC, 56 BC

[56] References Cited

U.S. PATENT DOCUMENTS

| | | | |
|---|---|---|---|
| 1,176,986 | 3/1916 | Richards | 123/80 BA |
| 1,197,412 | 9/1916 | Wahlberg | 123/65 VA |
| 1,441,111 | 1/1923 | Paterson | 123/65 VA |
| 1,753,745 | 4/1930 | Goby | 123/80 C |
| 1,874,336 | 8/1932 | Niven | 123/81 C |
| 1,996,909 | 4/1935 | DuBois | 123/81 C |
| 2,016,062 | 10/1935 | Vigers | 123/81 C |
| 2,034,410 | 3/1936 | Meyer | 123/81 C |
| 2,092,841 | 9/1937 | Groskritz | 123/56 BC |
| 2,406,404 | 8/1946 | Ryde | 123/41.69 |
| 2,523,599 | 9/1950 | Sparmann | 123/65 VA |
| 2,839,036 | 6/1958 | Strang | 123/73 V |
| 3,756,206 | 9/1973 | Gommel | 123/317 |
| 3,815,566 | 6/1974 | Staggs | 123/65 VA |
| 4,708,107 | 11/1987 | Stinebaugh | 123/317 |
| 4,715,336 | 12/1987 | Schindler et al. | 123/318 |

FOREIGN PATENT DOCUMENTS

| | | | |
|---|---|---|---|
| 2552493 | 3/1985 | France | 123/317 |

*Primary Examiner*—David A. Okonsky

*Attorney, Agent, or Firm*—Charles E. Brown; Charles A. Brown

[57] ABSTRACT

An internal combustion engine having a sleeve valve wherein the sleeve valve is the cylinder sleeve of a respective cylinder whereby a very simple reciprocation and oscillation of the sleeve valve may be effected by means of a rotary valve which controls the intake of a fuel-air mixture into the crankcase of the engine. By suppying the fuel-air mixture into the crankcase of the engine and providing each cylinder with transfer passages extending axially through the cylinder and radially adjacent cooling fins of such cylinders, it is possible to effect an isothermal compressing of a fuel-air mixture within the cylinder followed by that fuel mixture being adiabatically compressed by the movement of the respective piston towards the head. The use of a sleeve valve, particularly in association with rotary intake valves, provides for a very simple valving arrangement with a minimum of parts. Two such engines may be mounted in shaft-to-shaft relation and simultaneously drive coaxial shafts in opposite directions to provide for counter rotating propellers for an aircraft. The engine construction provides for a maximum power output with a minimum weight.

13 Claims, 3 Drawing Sheets

INTERNAL COMBUSTION ENGINE ASSEMBLY

This invention relates in general to new and useful improvements in internal combustion engines, and more particularly, relatively small, high speed engines which are light in weight and particularly adaptable for use with respect to lightweight aircrafts and drones, although satisfactory for installations such as snowmobiles and the like.

One of the features of the engine is that the valving is of the sleeve valve type with the sleeve valve being in the form of a cylinder sleeve which is mounted within a cylinder for both reciprocatory and circumferential oscillatory movement. Another feature of the engine is that the cylinder sleeve which forms the sleeve valve has transfer ports in the form of notches in a head end of the cylinder sleeve with the notches overlapping in telescoped relation a portion of a cylinder head to completely seal the cylinder at the time of ignition.

Another feature of the invention is the provision of an internal combustion engine having a rotary intake valve which is utilized to effect the reciprocation and oscillation of a sleeve valve in the form of a cylinder sleeve.

Yet another feature of the invention is to provide an internal combustion engine wherein a fuel-air mixture is directed into the crankcase of the engine by way of a rotating inlet valve member which, in turn, also functions as the drive means for reciprocating and oscillating the cylinder sleeve.

Yet another feature of the invention is an arrangement wherein the fuel-air mixture is directed into the interior of the crankcase of the engine and then transferred to the individual cylinder by way of transfer passages formed in each cylinder with the transfer passages being cooled by way of fins on the cylinder so that the fuel-air mixture entering into each cylinder is compressed as the piston or pistons retract towards the crankcase with there being an isothermal compression of the fuel-air mixture directed into the cylinder, followed by an adiabatic compression of the fuel-air mixture within the cylinder by the piston.

A further feature is the utilization of two engines in an aircraft for driving counter rotating propellers with the engines being in alignment with one another so as to minimize engine cross sectional profile and the engines being in shaft-to-shaft relation wherein although the engines are identical and rotate in like directions, the engines drive two propeller shafts, which are coaxially arranged, in opposite directions.

With the above and other objects in view that will hereinafter appear, the nature of the invention will be more clearly understood by reference to the following detailed description, the appended claims, and the several views illustrated in the accompanying drawings.

Figure 1:
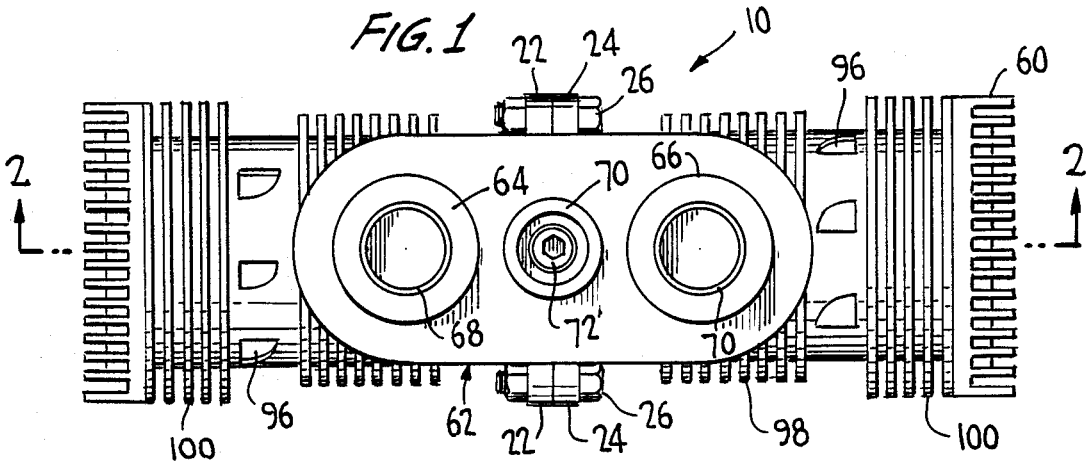
FIG. 1 is a rear end elevational view of an engine formed in accordance with this invention.
Figure 2:
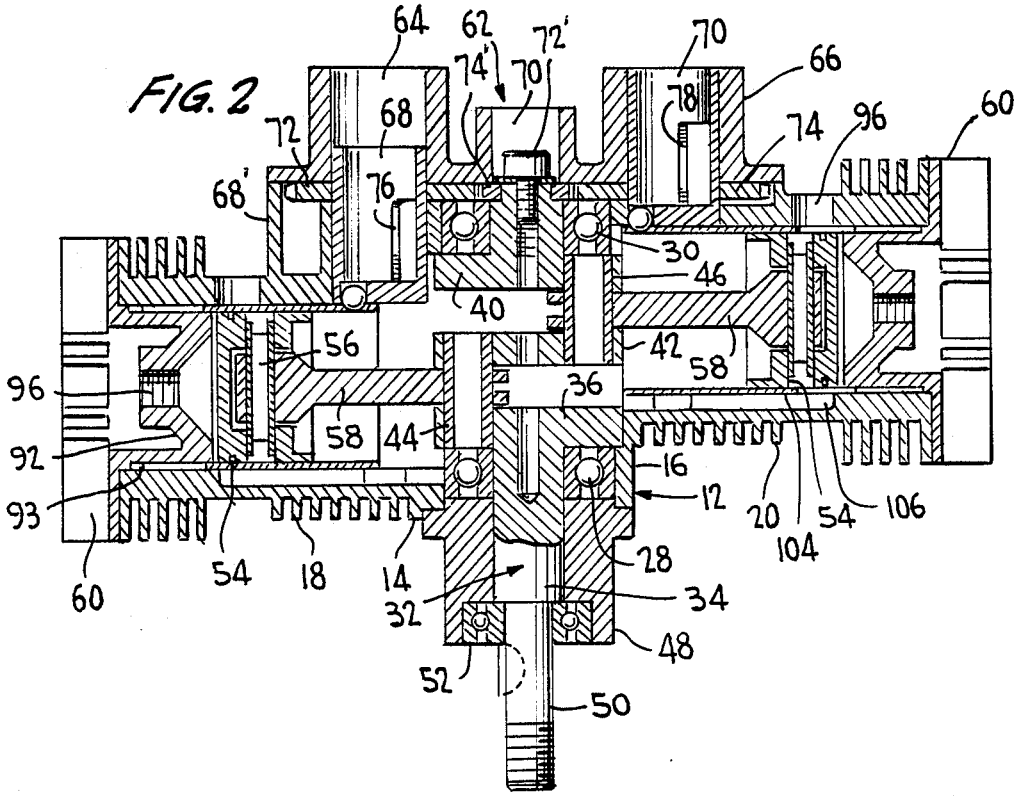
FIG. 2 is a horizontal cross sectional view taken through the engine of FIG. 1 generally along the line 2—2.
Figure 3:
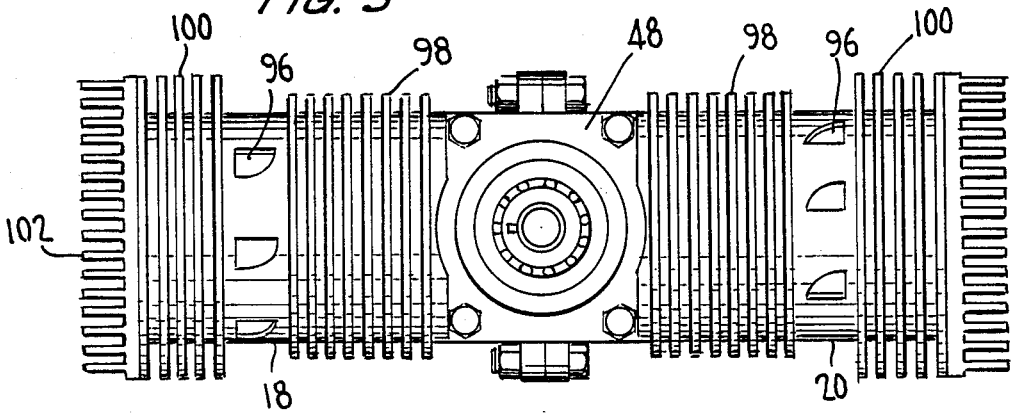
FIG. 3 is a front elevational view of the engine of FIG. 1.

Referring now to the drawings in detail, reference is first made to FIGS. 1, 2 and 3 wherein the general details of the engine, which is the principal feature of this invention are illustrated. The engine, which is generally identified by the numeral 10, is a two cylinder four stroke cycle internal combustion engine and includes a crankcase, generally identified by the numeral 12 which is of a split construction and includes left and right crankcase sections 14, 16. The crankcase section 14 carries an integrally molded cylinder 18 while the crankcase section 16 includes an integrally molded cylinder 20. The cylinders 18, 20 are generally in opposed, axially offset relation as is clearly shown in FIGS. 1 and 2.

The crankcase sections 14, 16 are provided with assembly flanges 22, 24, respectively, on opposite sides thereof which are joined together by through bolts 26.

The crankcase 12 has mounted in opposite ends thereof a front bearing 28 and a rear bearing 30 in which a sectional crankshaft, generally identified by the numeral 32, is mounted for rotation.

The crankshaft includes a front nose 34 which carries at the rear end thereof a counterweight 36. The nose 34 is rotatably journalled in the bearing 28. The crankshaft 32 also includes a rear nose 38 which carries a counterweight 40. The rear nose 38 is rotatably journalled in the bearing 30.

The crankshaft 32 further includes a center counterweight 42 with the counterweights 36, 42 being joined together by a rod journal 44 which is pressed into both of the counterweights 36, 42. A rodlike journal 46 is pressed into the counterweights 40, 42 and in a like manner joins together these counterweights so as to provide a customary 180° two journal crankshaft.

In the forward end of the crankcase 12 there is a front trunion 48 which seals the front bearing 28 in the crankcase and which is telescoped over and beyond the nose or front journal 34 of the crankshaft.

The crankshaft 32 further has a reduced diameter forward shaft portion 50 which forms an extension of the nose 34 and which is rotatably journalled in a bearing 52 carried by the front trunion.

In each of the cylinders 18, 20 there is mounted for reciprocatory movement a piston 54 which by way of a pin assembly 56 is connected to a connecting rod 58 which, in turn, is connected to the respective one of the journals 44, 46. While no bearing means has been provided between the connecting rod 58 and the respective crankshaft journal, it is to be understood that any suitable type of bearing means may be utilized including needle bearings.

Each of the cylinders 18, 20 is provided with a head 60 which closes the open end of the respective cylinder. The heads 60 are secured to their respective cylinders for replacement by head bolts (not shown).

The engine 10, as described, could be of a conventional construction. However, there are other features of the invention, particularly with respect to the introduction of a fuel-air mixture into each of the cylinders, which are different and believed to be novel.

First of all, there is bolted to the rear of the crankcase 12 a timing cover 62. The timing cover 62 is provided with a pair of intake ports 64, 66 which, in turn, are associated with an intake manifold 68'. The intake manifold 68' is sealed relative to the crankcase and opens thereinto for supplying a fuel-air mixture into the crankcase 12.

The timing cover 62 is also provided with a centrally located access opening 70 through which access to bolt 72' holding a timing gear 74' on the rear nose or tail piece 38 of the crankshaft is obtained.

Cup-shaped rotary intake valves 68, 70 are mounted for rotation in the intake ports 64, 66. The valves 68, 70 carry gears 72, 74 which are engaged with the timing gear 74'. The intake valves 68, 70 have formed in the cylindrical walls thereof ports 76, 78, respectively which become aligned with intake openings in the manifold 68 so as to permit the entrance of a fuel-air mixture into the crankcase 12.

At this time it is pointed out that while the same has not been illustrated, the intake ports 64, 66 will be provided with suitable carburetion or fuel injection apparatus. Inasmuch as the manner in which the required fuel-air mixture is formed and directed into the intake ports 64, 66 is not part of this invention, no attempt has been made to illustrate the same.

Figure 7:
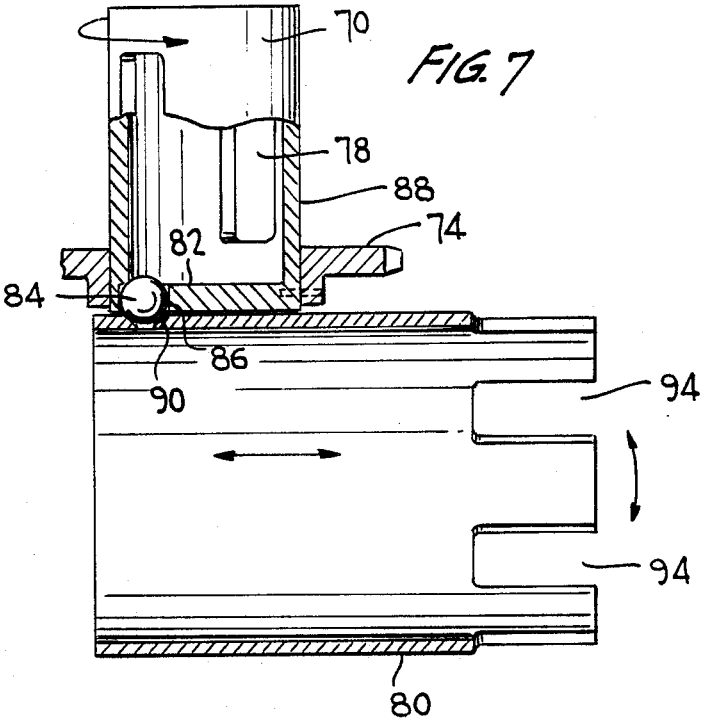
FIG. 7 is an enlarged fragmentary elevational view with parts broken away and shown in section of a rotary intake valve having the dual function of reciprocating and oscillation the sleeve valve.

Reference is now made to FIG. 7 wherein there is illustrated the details of a sleeve valve 80 which is the primary internal valving element of the engine. Each of the cylinders 18, 20 is provided with a sleeve valve 80 and the sleeve valve is actually a cylinder sleeve in which an associated piston 54 directly reciprocates and which the customary piston rings of the piston customarily seals. However, as opposed to having a pressed fit within its respective cylinder, the sleeve valve 80 is mounted for both reciprocatory and oscillatory movement as indicated by the arrows. In order to effect the reciprocation and oscillation of the sleeve valve 80, the sleeve valve 80 is coupled to a respective one of the rotary valves 68, 70, the valve 70 being illustrated. The rotary valve 70 is provided with a bottom wall 82 which generally opposes a side of the sleeve valve 80 and is coupled to the sleeve valve 80 by means of a ball 84. It will be seen that the ball 84 is seated in a bore 86 in the end wall 82 immediately adjacent a cylindrical wall 88 of the rotary valve 70 so that the ball 84 cannot pass through the bore 86 into the interior of the rotary valve 70. The exterior of the sleeve valve 80 is provided with a recess 90 in which the ball 84 is also partially seated.

Thus as the rotary valve 70 rotates, and the ball 84 moves along a circular path, the sleeve valve 80 will be simultaneously moved to the right while being moved first circumferentially in the first direction and then returned at the end of the stroke of the sleeve valve 80 to the right. Then as the rotary valve 70 continues to rotate, the sleeve valve will be moved back to the left to a starting position while it is rotated in the opposite direction first to an open position and then back to a closed position.

At this time reference is made once again to FIG. 2 wherein it will be seen that each cylinder head 60 includes a plug portion 92 which extends down into the respective cylinder in telescoped, but radially spaced relation so as to leave an annular space 93. The plug portion 92 will be provided with a threaded bore 96 for the usual spark plug or, if desired, glow plug. The annular space 93 is of a radial dimension so as to receive the top end of the sleeve valve 80.

Referring once again to FIG. 7, it will be seen that the top end of the sleeve valve 80 is provided with a plurality of circumferentially spaced transfer ports 94. The transfer ports 94 open through the top edge of the sleeve valve 80 and will be described in more detail hereinafter.

Next, with particular reference to FIG. 3, it will be seen that each of the cylinders 18, 20 will be provided with a circular belt area through which exhaust ports 96 open. Each of the cylinders 18, 20 is provided with a set of fins 98 below the belt area and a further set of fins 100 above the belt area, but no cooling fins 98, 100 in the belt area. It will also be seen that the heads 60 are provided with suitable cooling fins 102.

Figure 4:
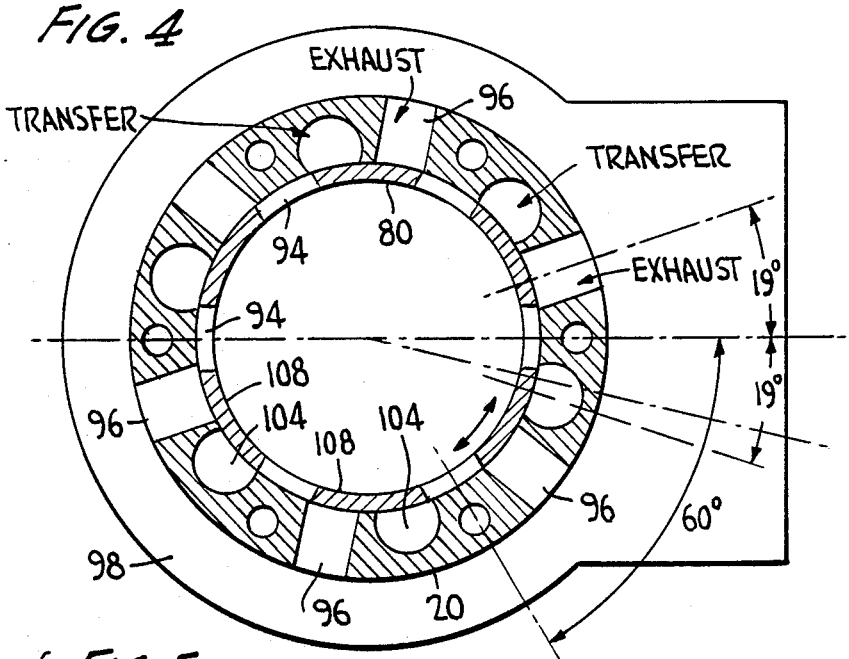
FIG. 4 is a schematic transverse sectional view taken through one of the engine cylinders and shows the arrangement of ports therein.

Next, as is best shown in FIGS. 2 and 4, each of the cylinders 18, 20, the cylinder 20 being illustrated, is provided with axially extending transfer passages 104 which are disposed adjacent a respective exhaust port 96. Each of the transfer passages 104 extends from generally the bottom of the respective cylinder into the crankcase 12 and to an upper part of the cylinder where it is radially inwardly curved so as to define an intake port 106 as shown in FIG. 2.

Further, as is clearly shown in FIG. 4, the respective sleeve valve or cylinder sleeve 80 forms an inner portion of the wall of each of the transfer passages 104 in that the transfer passages 104 open radially into the interior of the respective cylinder for the full length of the transfer passage.

The transfer ports 94 of the sleeve valve 80 are separated by valve closing elements 108 which, in the fully retracted position of each sleeve valve 80, is generally aligned with and closes both a respective exhaust port 96 and an intake port 106. On the other hand, when the sleeve valve 86 is in its fully projected position, the notched head end thereof is recessed within the annular space 93 and is closed by the plug portion 92 of the respective cylinder head 60.

Figure 5:
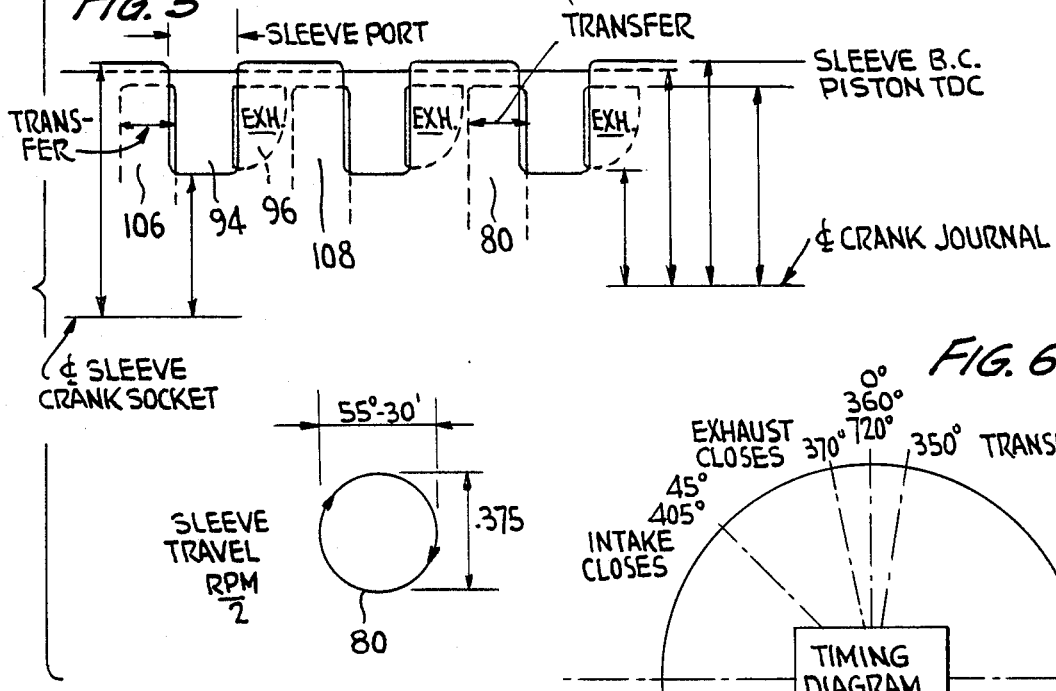
FIG. 5 is a schematic view showing the reciprocation and oscillation of the cylinder sleeve with relation to cylinder ports.

Referring now to the schematic showing of FIG. 5, it will be seen that each of the sleeve cylinders 80 in accordance with the particular valving of the engine in question, oscillates through an angle on the order of 55° 30' in each direction. This is sufficient to provide for the complete uncovering of both the exhaust ports 94 and the transfer ports 96. Further, as is clearly shown in FIG. 5, the movement of the valve cylinder 80 is sufficient to provide the necessary axial overlap between the transfer ports 94 and the exhaust ports 96 and the intake ports 106. At the same time, as described above, when the sleeve valve or cylinder sleeve 80 reaches its top dead center position, the transfer ports 94 will be axially beyond the exhaust ports 96 and the intake ports 106.

Figure 6:
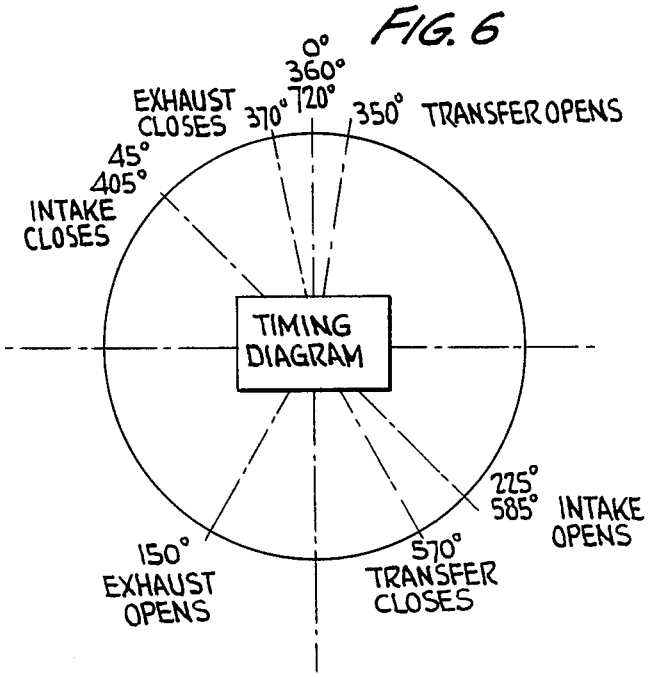
FIG. 6 is a timing diagram with two revolutions of the crankshaft.

The timing of the engine is best shown in FIG. 6 wherein EXHAUST relates to the opening and closing of the exhaust ports 96, TRANSFER relates to the opening and closing of the transfer ports 106, and INTAKE makes reference to the opening and closing of the rotary intake valves to the manifold. It is to be understood that the timing of the two cylinders is 180° apart or 360 crankshaft degrees. Thus while the two pistons are simultaneously at top dead center and bottom dead center positions, they are with respect to the crankshaft rotation, 360° out of time.

Referring once again to FIG. 4, it will be seen that the transfer passages 104 are formed in the respective cylinder adjacent the cooling fins 96. Thus the fuel-air mixture which is transferred from the crankcase into an individual cylinder is cooled. Further, because the intake ports 106 of the respective cylinder open and then close over a long period of time, it will be seen that as the fuel-air mixture is being compressed by the retracting pistons, the fuel-air mixture is being pumped, under cooling conditions into the respective cylinder. As a result, the fuel-air mixture is primarily compressed within the respective cylinder with the compression being an isothermal compression due to the cooling of the fuel-air mixture flowing from the crankcase into the cylinder. Then, as the transfer ports 106 close and there is further movement of the respective piston towards the respective head, there is the customary compression of the fuel-air mixture within the cylinder with this compression an adiabatic compression. As a result, maximum power can be obtained.

At this time, it is pointed out that no ignition system has been illustrated or described. The igniter may be in the form of a conventional spark plug or may be in the form of a glow plug. In the event the igniter is in the form of a spark plug, a suitable magneto arrangement may be provided and suitably driven such as by way of the equivalent of a flywheel.

Figure 8:
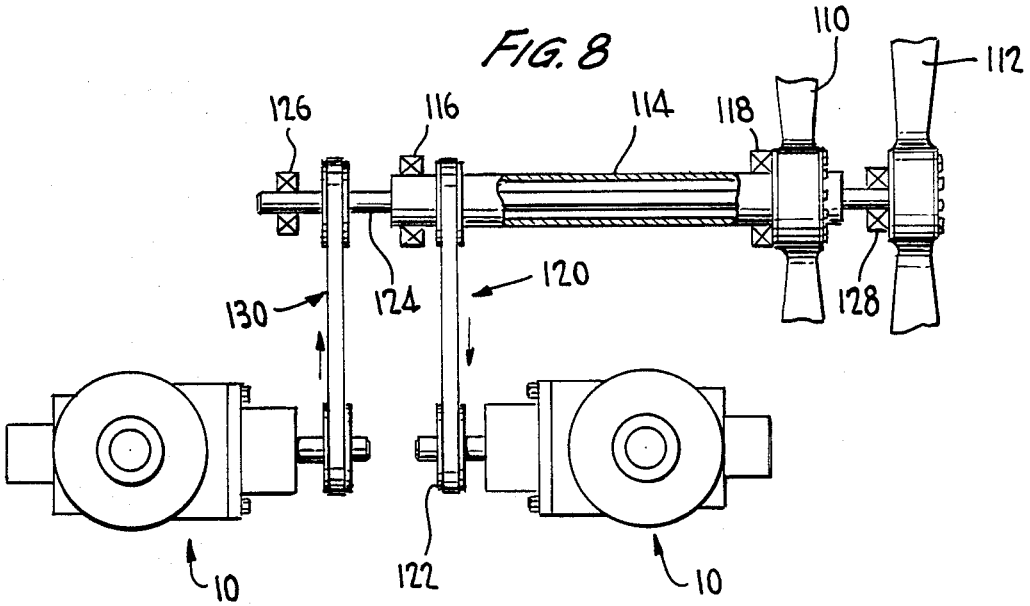
FIG. 8 is a schematic side elevational view showing two engines constructed in accordance with this invention disposed in shaft-to-shaft relation and driving coaxial propeller shafts in opposite directions.

Referring now to FIG. 8, there is schematically illustrated the manner in which two of the engines 10 may be utilized to drive two counter rotating aircraft propellers 110, 112. First of all, it is to be understood that the two propellers 110, 112 are the pusher type. Thus the propeller 110 is the forward propeller. The propeller 110 is carried by a tubular shaft 114 which is rotatably journalled in two bearings 116, 118. The shaft 114 is driven from the rearmost of the two engines 10 by way of a sprocket and belt arrangement generally identified by the numeral 120. If desired, a sprocket 122 of this arrangement, which is carried by the engine crankshaft, may be in the form of a flyweight or may include the aforementioned magneto.

The rear propeller 112 is carried by a shaft 124 which is coaxial with the tubular shaft 114. The shaft 124 may either be mounted in bearings carried by the tubular shaft 114 or may be separately or additionally supported by further bearings 126, 128. The forward motor 10 is coupled to the shaft 124 by a second coupling or drive assembly 130 which may be identical to the drive assembly 120.

At this time it is pointed out that there is a definite advantage in the two twocylinder engines as opposed to the use of one four-cylinder engine. First of all, because the shafts of the two engines are arranged in shaft-to-shaft relation, the wind resistance of the two engines is the same as that of one engine. Next, by having the shafts of the two engines in opposed relation, although both engines rotate in the same direction, the driving effect of the two engines is in opposite directions as indicated by the arrows so that the shafts 114 and 124 rotate in opposite directions thereby permitting the propellers 110, 112 to rotate in opposite directions to counteract the side thrust of the propellers.

Although only a preferred embodiment of the invention has been specifically illustrated and described herein, it is to be understood that minor variations may be made in the engine construction without departing from the spirit and scope of the invention as defined by the appended claims.

I claim:

1. An internal combustion engine comprising a cylinder, a cylinder sleeve mounted in said cylinder for axial reciprocating circumferential oscillating movement, said cylinder sleeve forming a valve member and having a head end, said cylinder sleeve having at said head end a single set of circumferentially spaced control ports, said cylinder having a set of circumferentially spaced intake ports and a set of circumferentially spaced exhaust ports alternating with said intake ports, the relationship of said control ports and said intake and exhaust ports being one wherein in an advanced position of said cylinder sleeve said control ports are axially beyond said intake and exhaust ports with said cylinder sleeve closing both said intake ports and said exhaust ports, in an intermediate advancing position of said cylinder sleeve said control ports are in communication with said intake ports, and in an intermediate retracting position of said cylinder sleeve said control ports are in communication with said exhaust ports.

2. An engine according to claim 1 wherein said engine includes a crankcase, and said intake ports are transfer ports extending from said crankcase.

3. An engine according to claim 2 wherein said cylinders have cooling means, and said cooling means being operative to cool said transfer ports and gases therein.

4. An engine according to claim 2 together with timing means for effecting said reciprocation and oscillation of said cylinder sleeve, said timing means including a rotating inlet valve in communication with said crankcase.

5. An engine according to claim 4 wherein said rotating intake valve is generally cup shaped and has an open end and a closed end, said rotating intake valve being mounted for rotation about an axis normal to said cylinder, and means coupling said closed end to said cylinder sleeve.

6. An engine according to claim 5 wherein said coupling means is in the form of a ball partially seated in said closed end and partially seated in said cylinder sleeve.

7. An engine according to claim 1 wherein said control ports are in the form of open end notches opening through said cylinder sleeve head end.

8. An engine according to claim 2 wherein said cylinder sleeve forms a wall portion of said transfer parts in all positions of said cylinder sleeve.

9. A four stroke cycle internal combustion engine comprising a crankcase, a crankshaft rotatably journalled in said crankcase, at least two cylinders carried by said crankcase and extending in opposite directions from said crankcase, a piston in each of said cylinders coupled to said crankshaft for reciprocation, valved intake means actuated by said crankshaft for the controlled admission of a fuel-air mixture into said crankcase for compression by said pistons, separate transfer passage means carried by each of said cylinders in direct communication with said crankcase for timed transfer of the fuel-air mixture into said cylinders above said pistons, valving for opening said transfer passage means into a respective one of said cylinders in timed relation to the compressing of the fuel-air mixture in said crankcase, and said transfer passage means including cooling means for cooling the fuel-air mixture being transferred from said crankcase into said cylinders wherein the compressed fuel-air mixture in said cylinders is as a result of isothermal compression followed by adiabatic compression of the fuel-air mixture in each of said cylinders by a respective one of said pistons.

10. An engine according to claim 9 wherein each of said cylinders includes cooling fins, and said transfer passage means extend axially of said cylinders adjacent said cooling fins.

11. An engine according to claim 9 wherein said valving includes a cylinder sleeve mounted in each cylinder for axial reciprocating circumferential oscillating movement, said cylinder sleeve forming a valve member and having a head end, said cylinder sleeve having at said head end a single set of circumferentially spaced control ports, each cylinder having a set of circumferentially spaced intake ports and a set of circumferentially spaced exhaust ports alternating with said intake ports, the relationship of said control ports and said intake and exhaust ports being one wherein in an advanced position of said cylinder sleeve said control ports are axially beyond said intake and exhaust ports with said cylinder sleeve closing both said intake ports and said exhaust ports, in an intermediate advancing position of said cylinder sleeve said control ports are in communication with said intake ports, and in an intermediate retracting position of said cylinder sleeve said control ports are in communication with said exhaust ports.

12. An engine according to claim 11 wherein each of said cylinders includes cooling fins, and said transfer passage means extend axially of said cylinders adjacent said cooling fins.

13. An engine according to claim 12 wherein said cylinder sleeve forms a wall portion of each of said transfer passage means in all positions of said cylinder sleeve.

* * * * *